US005421945A

United States Patent [19]

Schwarz

[11] Patent Number: 5,421,945

[45] Date of Patent: Jun. 6, 1995

[54] PROCESS AND DEVICE FOR MASS CONSERVATION OF ARCHIVES

[76] Inventor: Günther Schwarz, Zum Hiltruper See 25, D-4400 Münster-Hiltrup, Germany

[21] Appl. No.: 976,981

[22] PCT Filed: Jun. 2, 1992

[86] PCT No.: PCT/EP92/01229

§ 371 Date: Feb. 1, 1993

§ 102(e) Date: Feb. 1, 1993

[87] PCT Pub. No.: WO92/21817

PCT Pub. Date: Dec. 10, 1992

[30] Foreign Application Priority Data

Jun. 4, 1991 [DE] Germany ..... 41 18 249.9

[51] Int. Cl.[6] ..... B65C 9/25

[52] U.S. Cl. ..... 156/324; 156/555; 156/583.5

[58] Field of Search ..... 156/94, 324, 555, 578, 156/583.1, 583.5, 498, 311; 100/93 RP, 153, 154; 425/371

[56] References Cited

U.S. PATENT DOCUMENTS

| | | | |
|---|---|---|---|
| 2,511,703 | 6/1950 | Ettl | 156/555 X |
| 3,671,355 | 6/1972 | Paymal | 156/324 |
| 4,687,528 | 8/1987 | Held | 156/150 |
| 4,997,507 | 3/1991 | Meyer | 156/286 |
| 5,141,583 | 8/1992 | Held | 156/324 |
| 5,149,394 | 9/1992 | Held | 156/555 |

FOREIGN PATENT DOCUMENTS

| | | |
|---|---|---|
| 3802797 | 8/1989 | Germany . |
| 1007981 | 10/1965 | United Kingdom . |

OTHER PUBLICATIONS

Abstract Bulletin of the Institute of Paper Chemistry, vol. 57, No. 1, Jul. 1986, Appleton US, p. 80, Yates "Conservation of Nineteenth century tracing paper".

Paper Conservator, No. 8, 1984, Yates, S. A., "The Conservation of Nineteenth-Century Tracing Paper", pp. 20–39.

*Primary Examiner*—David A. Simmons
*Assistant Examiner*—J. Sells
*Attorney, Agent, or Firm*—Jordan and Hamburg

[57] ABSTRACT

The mass preservation of archives by melting on them a binder combination reinforced with a nonwoven or woven fabric, in which a woven or nonwoven fabric on a supporting belt or supporting roller is impregnated with an aqueous, pollutant-free, self-cross-linking and/or not self-cross-linkable and/or pre-cross-linked dispersion, free of volatile solvents, of a thermoplastic binder with a high film-forming temperature above 60° C., into which dispersion waxes or paraffins, with a concentration—based on the solids portion of the dispersion—of 3 to 10% by weight have been incorporated by hot precipitation, dried and, in conjunction with the substrate that is to be preserved, fused under the action of pressure and temperature by a brief temperature shock at a temperature appreciably exceeding the film-forming temperature to a substrate-sealing film with embedded nonwoven or woven fabric.

22 Claims, 1 Drawing Sheet

PROCESS AND DEVICE FOR MASS CONSERVATION OF ARCHIVES

BACKGROUND OF THE INVENTION

The invention relates to a process for the mass conservation of archives by melting a binder combination, which is reinforced by a nonwoven or woven fabric preferably onto both sides.

Recently, because of the alarming news from all libraries and archives, strenuous efforts have been made to rescue printed and written works, which are faced with disintegration and are threatened by wear through use and especially by the time-limited durability of the paper.

The cause of the slight durability of especially modern papers are sulfuric acid and acid-forming components, which have been used in the industrial production of paper since 1850. Unfavorable storage conditions, such as heat, high humidity and climatic fluctuations accelerate the disintegration.

To maintain especially these archives with papers from the period since 1850, a series of chemical methods have been proposed, which consists essentially of exposing the archives to a gaseous or also a liquid neutralizing medium, in order to prevent further destruction by neutralization of the acid constituents of the paper. Admittedly, the further disintegration of the paper can be prevented by such methods; however, the earlier, satisfactory nature of the paper cannot be restored. In particular, the brittleness of the paper, once it has set in, still remains even after such a neutralization. In any case, extensive technical equipment is required for the de-acidification. Such equipment can only be built at a central location and operated by specially trained personnel, so that the archives have to be transported to such a central location for treatment. As a result, the danger of damage to the brittle archives during transport is increased quite appreciably. Moreover, this method is also very expensive and, as already stated, does not help at all in those cases, in which the disintegration of the paper has progressed to such an extent, that use of the neutralized and de-acidified paper is in any case no longer possible for no other reason than because of the brittleness that has developed.

Moreover, a strengthening of paper, which has become brittle due to acid deterioration, has, of course also been attempted. Until now, however, only manual methods are available for this, but no methods that are suitable for mass preservation.

At the present time, the strengthening is carried out manually by using polyethylene film as an adhesive layer in conjunction with nonwoven fabric at a relatively long pressing time (5 to 6 minutes) and at relatively high temperature (120° C.). The result is anything but optimum. The typography is blurred and the high pressing temperature in conjunction with the, after all, relatively long pressing time strongly affects the archive material that is to be restored.

SUMMARY OF THE INVENTION

It is therefore an object of the invention to develop further a method for mass preservation using plastic layers preferably melted on both sides in such a manner, that it can be carried out rapidly and simply with the least possible contamination of the environment and without great expense for the equipment and so that, in particular, it also is possible to use the method decentrally even in smaller archives. Moreover, the typography shall not be blurred nor shall the identifiability deteriorate otherwise.

Pursuant to the invention, this objective is accomplished by impregnating a woven or nonwoven fabric on a supporting belt or supporting roller with an aqueous, pollutant-free, self-cross-linking and/or not self-cross-linkable and/or pre-cross-linked dispersion, free of volatile solvents, of a thermoplastic binder with a high film-forming temperature above 60° C., into which dispersion waxes or paraffins, with a concentration—based on the solids portion of the dispersion—of 3 to 10% by weight have been incorporated by hot precipitation, drying and, in conjunction with the substrate that is to be preserved, fusing under the action of pressure and temperature by a brief temperature shock at a temperature appreciably exceeding the film-forming temperature to a substrate-sealing film with embedded nonwoven or woven fabric.

By means of the inventive method, a strengthening of the archives is attained in the simplest manner with the highest transparency and adhesion between the applied sealing film and the substrate. Moreover, the doubly-sealed substrate continues to be a thin film, which is not much thicker than the original substrate itself, and is fully flexible once again, even if it had been completely brittle previously. The inventive combination of a method for producing rapidly curing coatings from supporting materials of the German patent 38 02 797 with the use of embedded nonwoven fabric provides a possibility for sealing archives, which is extremely easy to handle. The inventive, brief temperature shock, moreover, has the very decisive advantage that only the coating, which is actually to be fused into a film, is heated and not also, for example, the supporting material, that is, the substrate that is to be preserved. This means that the substrate is not adversely affected at all, particularly if, immediately after the fusion of the film, external cooling is provided, so that the heat contained in the layer is drawn off again, before it can be conveyed towards the inside to the substrate. The inventive method, for which nonwoven fabrics of cellulose, glass, synthetic or carbon fibers or, of course, also mixtures of such fibers can be used, ultra-thin, nonwoven fabrics being preferably used, moreover, also offers the advantage, that, by adjusting the binder to a pH of more than 7, neutralization of the acid content can also take place simultaneously with the decisive, mechanical strengthening of the substrate, so that further disintegration can no longer take place. The inventive method therefore no longer requires the de-acidification of the paper that was required previously, together with the help of the anyhow already expensive method developed for this purpose and a subsequent, also very expensive strengthening, which is useless in practice. Instead, the de-acidification and the strengthening can be brought about simultaneously with a melt-coating method with incorporated reinforcing nonwovens, which can be carried rapidly and rationally.

It is, for example, possible to add solvent-free alkalis, which do not split off any pollutants, to these binder combinations. Furthermore, the addition of epoxidized oils or also of 4-t-butyl pyrocatechol prevents the further disintegration of the cellulose fibers.

It has been observed that the binders with a high melting point or high minimum film-forming temperature (MFT), which are provided pursuant to the invention and can be applied in a conventional manner, for example, by rollers, by doctor blades, by spraying, troweling, pouring or electrostatic spraying, when exposed to a high temperature, are subject to a sudden melting process and, at the same time, form a coherent film. This is also the case when the binder is disposed on a nonwoven fabric which, when the binder uses to a film, is then embedded as a strength-increasing reinforcement in the film. This film formation under temperature shock eliminates leveling disorders such as the "orange peel effect", "roller corrugations", "doctor blade striations", "raster effects", etc., which very frequently cannot be avoided when liquid or pasty coating materials are applied, no matter how carefully the formulation is designed and the viscosity is controlled. Due to the high melting temperature or the high MFT, the film, formed in the melting process, solidifies equally suddenly after it has left the temperature zone, so that immediately after the temperature shock, the film can be stacked, has block strength, can be rolled up, etc. and, at the same time, the resulting surface is resistant to mechanical and chemical effects. It has proven to be particularly advantageous to use dispersions based on, for example, acrylates and methacrylates as well as their esters, nitriles, amides, vinyl acetate, styrene, butadiene, vinyl propionate, isobutene, polyurethane, and vinylidine.

Preferably, hard resins, which are water soluble or are made water soluble by amination, are used. Reactive resins, which are water dilutible or can be dispersed or emulsified in water by means of suitable emulsifiers, can contribute within the scope of thermal curing to the improvement in the resistance towards mechanical and chemical effects in conjunction with appropriate catalysts, promoters, accelerators (optionally also latent adjustments).

For this purpose, hard resins are, for example, copolymers of styrene and acrylic acid, while reactive resins can be, for example, systems that can be polycondensed (melamine-urea resins), resins capable of polymerizing (polyesters, acrylate resins) or resins capable of undergoing polyaddition reactions (polyurethane compounds) with the appropriate catalysts or reaction partners.

In the event that latent hardener systems are used, it is possible to produce one-component materials. It is a prerequisite here that the temperature, at which crosslinking commences, is higher than 100° C.

Water-dilutible liquids with reactive groups, which are included in the chemical reaction as components of the binder, can contribute to lowering the viscosity if the solids concentration is high. Moreover, they can exert a distinctly positive effect on the curing and film properties. Examples of such reactive diluents are polyols, polyethers, polyetherols and epoxides with, in each case, at least two reactive groups. Film formers (polyvinyl alcohol), plasticizers, wetting agents, defoamers, delustering agents, etc. can be used as formulation components for influencing the processing and film properties.

The inventive, brief temperature shock—the brief heating also has the advantage that only the coating actually fusing to a film is heated and not, for example, also the supporting material in the event that the layer is applied directly on the supporting material—can be achieved in various ways, for example, also by radiant heat. Preferably, however, the pre-dried layer is fused into the film in direct contact with a surface, heated to 100° to 200° C. and serving as an energy source. It is additionally advantageous if the film is cooled directly behind the heating equipment that leads to its formation. Corresponding to the preferred contact heating, either at a press surface or preferably at a heated calender roller, the possible cooling of the film after the film-forming heating equipment should, if possible, also be accomplished by a cooled calender roller. Instead of or in addition to this, contactless ducted cooling can also be provided.

Particularly also the hot precipitation in high concentration of wax or paraffin is of considerable importance for the inventive method, since an extremely fine dispersion of the wax or paraffin as well as a sort of enveloping effect of the individual dispersion by wax particles takes place. As a result, there is a significant improvement in the rheological properties resulting in very uniform application layers, independently of the way in which the layer is applied. Moreover, because of this envelopment of the dispersion particles by wax, there is a very rapid uniform fusion during the hardening of the fused mass. Quite evidently, chemical reactions, which have not been researched in detail, also occur during this fusion, since the layers formed in this manner have a high mechanical hardness, as well as extreme resistance to liquids. It has been observed that liquids have not penetrated through such a layer, even after days.

Moreover, the proportion of preferably hot precipitated waxes or paraffins makes a very simple transfer method possible in that the film is first formed on a roller or endless belt and is transferred from there to the actual carrier. By means of this inventive transfer method, particularly porous surface structures and surface structures with rough areas can also be provided with a smooth coating layer, without the use of excessively large amounts of dispersing agents, since the material does not have to be applied moist on the porous surface and thus also cannot penetrate to a high degree.

The hot precipitation of waxes brings about particularly good properties. However, it is not an essential prerequisite for a usable result. On the other hand, a relatively high proportion of wax of the order of at least 3 to 10% or even higher is of very special importance. Moreover, it has proven to be advantageous to combine wax and emulsifier during the wax precipitation.

The following waxes have proven to be particularly suitable for the inventive purposes: lignite wax (lignite acid or lignite ester waxes), polyethylene waxes, polymer dispersion, natural waxes, ethylene/vinyl acetate copolymers in conjunction with suitable emulsifiers.

Not only the type of wax or paraffin varieties used, but also the emulsifier system selected, have a decisive effect on important processing and surface properties (leveling, gloss, release effect, hardness, resistance). By the addition of appropriate emulsifiers, the loosening from the plastic belt, for example, can be thwarted completely so that an outstanding laminating adhesive can be obtained in this way.

The hardness, viscosity and gloss are also affected very much by the respective emulsifier (also combinations of different emulsifiers). The use of emulsifier in the amount of about 2 to 6%, based on the total formulation, has proven to be very appropriate.

The following materials have finally been particularly successful as emulsifiers: ethoxylated oleic acid, ethoxylated fatty alcohol, oleic acid alkylolamide or, preferably, ethoxylated castor oil.

The transfer method also permits structured films to be produced in a very simple manner in that, namely, the roller or belt has appropriate surface structuring, which is then retained correspondingly after transfer to the actual carrier.

In a particularly advantageous variation of the transfer method, the actual formation of the film, that is, the fusion of the film consisting of a pre-dried dispersion layer, takes places together with the transfer.

The above-addressed possible surface structuring of the binder films reinforced with woven or nonwoven fabrics has the great advantage that, for example, by producing a delustered surface, the readability of the print or the characters can be improved greatly in comparison to an excessively glossy surface with its interfering reflections. Moreover, it also depends largely on the binder combination used whether, for the transfer method, which is preferred over the direct coating method and is, of course, also possible for the mass preservation of archives, the nonwoven fabric is applied first on the transfer belt or on a transfer roller and then the dispersion, in order to impregnate the nonwoven fabric, or conversely, whether a film is applied first on the dispersion and the nonwoven or woven fabric is applied on this dispersion. In the first case, larger amounts of dispersion can be stored in the nonwoven or woven fabric, so that a greater degree of impregnation is assured and, with that, also the greatest possible transparency of the reinforced film.

It is of course also within the scope of the invention, even when using the transfer method, to carry out the actual formation of the pre-dried film with the incorporated nonwoven or woven fabric and the transfer and fusion on the archives to be preserved in a quasi one-step operation, or also to fuse a film of the binder and the woven or nonwoven fabric on the transfer belt and to draw off this finished thin film and wind it up on a roller, in order to supply these prefabricated, reinforced films then, for example, to the libraries, which then need only be provided with a relatively small, simple calender, in order to be able to fuse such a film onto the archives, which are to be protected by them. At the same time, the binder combination then melts a second time. However, this is possible without difficulties since the binder composition was reactivatable, that is, thermoplastic.

To implement the inventive method, it is particularly advantageous to provide an endless plastic or metal transfer belt, which revolves between a drying apparatus and a transfer station with heatable transfer rollers or transfer belts, as well as, optionally, an inlet and an outlet for the substrate to be coated and, on the return section from the transfer station or the winding up apparatus for the prefabricated film, passes through an application apparatus, as well as a supplying station for the woven or nonwoven fabric.

Admittedly, the preferred transfer method can also be carried out with the help of a transfer roller, on which the dispersion layer is applied first and pre-dried, in order to be transferred from the roller to the actual support. In practice, however, a transfer belt is generally to be preferred, if for no other reason than the greater length. The greater length of a transfer belt enables a plurality of application stations, as well as an independent pre-drying station to be disposed without difficulties ahead of the melt-contact hardening. In practice, therefore, a transfer apparatus using a transfer roller can only be used advantageously in special cases.

Although the film, formed pursuant to the invention by the hardening of the fused mass, can be detached quite without problems from the transfer belt or transfer roller—any loose particles are automatically removed by the ducted cooling—it may nevertheless be appropriate in some cases to dispose cleaning equipment for the transfer belt ahead of the application apparatus in order to remove parts of the coating or layers remaining on the transfer belt after any malfunctions, so that they are not incorporated in an interfering manner in the subsequently re-formed film. The application apparatuses for intermediate layers, for example, for an already addressed bonding layer or a paint priming coat, etc., are disposed after the drying apparatus, the use of a transfer belt instead of a transfer roller once again producing design and method advantages.

Aside from the use of cooled cooling rollers or a ducted cooling system, which directly follows the heatable transfer rollers in order to ensure a particularly sudden cooling of the film formed by the hardening of the fused mass and, with that, ensure a completely trouble-free further processing of the coated support, provisions can also be made in a further development of the invention to detour the transfer belt relative to the carrier, which is to be coated, between consecutive transfer rollers. By means of this detour, jolts of the belt as well as slight surface defects cannot disrupt the quality of the finished film decisively, since such defects in the region of two consecutive rollers are no longer disposed in the same location of the coating.

To improve the release effect and achieve certain (for example, very delustered) surfaces, it is also possible to use appropriate silicone release papers.

BRIEF DESCRIPTION OF THE DRAWING

Further advantages, characteristics and details arise out of the following description of some embodiments as well as from the drawing, in which.

DESCRIPTION OF THE PREFERRED EMBODIMENTS

Figure 1:
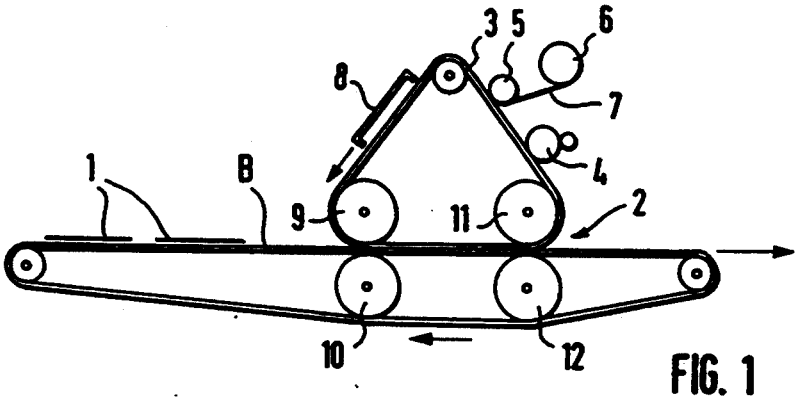
FIGS. 1 and 2 show different diagrammatic embodiments of the inventive double-belt machine and FIGS. 3 and 4 show diagrammatic representations of calender machines for the inventive, mass preservation of archives.

For the double-belt machine shown in FIG. 1, the archive materials, indicated as sheets 1, are supplied over belt B of a double-belt machine 2, the upper belt of the double-belt machine 2 being constructed as a transfer belt 3. On this steel or plastic transfer belt 3, the binder dispersion is applied as a layer in a station 4, while a thin nonwoven fabric or paper 7 is applied from a roll 6 in a subsequent station 5. The nonwoven or woven fabric, impregnated with the dispersion, is moved past a drying station 8, with, for example, hot air nozzles, so that the binder is dried. Subsequently, the transfer belt with the dried, impregnated nonwoven fabric arrives between the rollers of the double-belt machine. At least the upper inlet roller 9 is heated so that as the sheet to be preserved is drawn into the gap between the rollers, the binder is fused suddenly into a film. For sealing on one side, it is advisable not to heat the counterpressure roller 10 of roller 9, in order to avoid heating the sensitive archives, that is, the sheets 1. Similarly, the rollers 11 and 12 in the outlet gap of the double-belt machine should be cooled if possible, in order the limit the danger as much as possible of heating the archives from the heated film layer. If both sides are to be sealed simultaneously in one passage, the counterpressure roller must, of course, also be heated, since in this case the sealing nonwoven fabric is also supplied from the opposite side.

Figure 2:
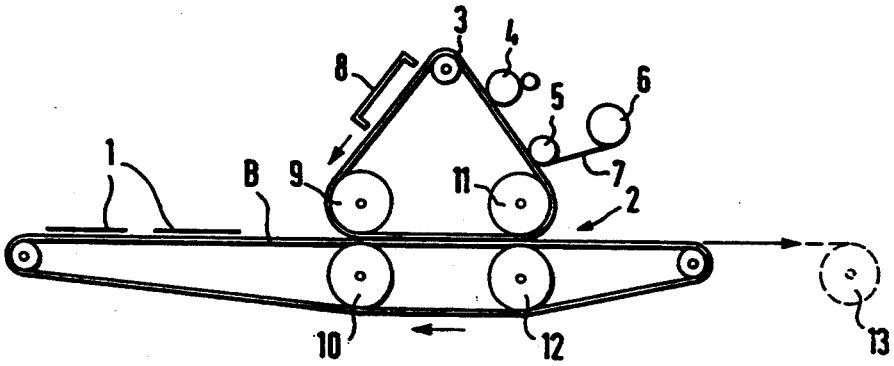
Figure 3:
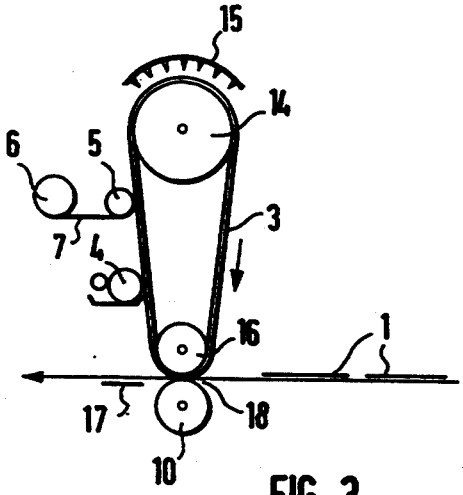

The arrangement of FIG. 2 differs from that of FIG. 1 only in that the position of the binder application station 4 and the nonwoven supplying station 5 are exchanged. In other words, the nonwoven or woven fabric is applied first on the transfer belt 3 and is then impregnated directly with the binder dispersion.

Moreover, it is indicated in FIG. 2 that the film belt with internal nonwoven or woven fabric reinforcement, which is fused in the double-belt machine, can be drawn off over a roll 13; in this case, of course, no sheets 1 are supplied at the inlet side. The roll 13 is then passed on to the appropriate libraries, archives, etc., so that these can apply the prefabricated film on the archives with the help of a simple laminating machine. Even when sheets are supplied, it is advantageous to roll up, in order to then seal the opposite side in a second passage. In most cases, it is useful to roll up the sealed archives, in order to cut and trim them only later.

Figure 4:
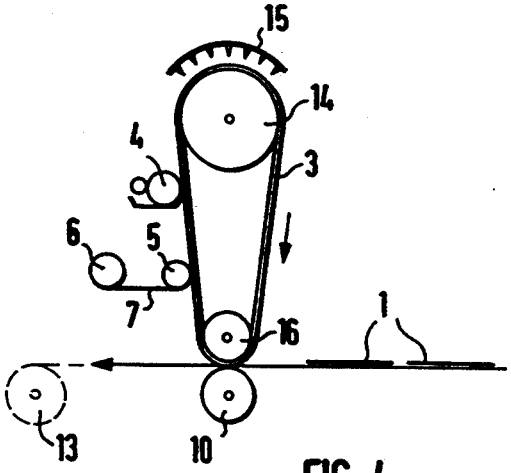

In deviation from the double-belt machines of FIGS. 1 and 2, FIGS. 3 and 4 show calendering apparatuses; in other respects, however, the mode of functioning is essentially the same. The transfer belt 3 once again runs past the binder application station 4 and the nonwoven fabric supplying station 5 (or in the reverse order in FIG. 4). Over a heated guiding drum 14, which may be provided additionally with a hot-air nozzle drying section 15, the pre-dried layer reaches the heated calender 16. The sheets 1, which are to be preserved, are supplied to the drawing-in gap 18 of the calender 16. Between the calender 16 and its counterpressure roller 10, the nonwoven fabric is brought together with the binder mixture and the sheet 1, the binder mixture melting as the film with the incorporated nonwoven or woven fabric melts on the sheet 1. The calender is followed at 17 by a cooling system, which can either be contact cooling by a roller or also by air jet cooling. In FIG. 4, in much the same way as in FIG. 2, it is indicated once again that the film, formed at the calender from the nonwoven or woven fabric and the binder mixture by fusion, does not have to be melted immediately after it is formed onto the sheet 1, but can also be drawn off over a roller 13, so as to then make it available as a prefabricated film to smaller libraries. These libraries would then merely need a simple melting calender in order to be able to melt such a film onto their archives for sealing.

Aside from the arrangement shown, for which in each case only one side is provided with a sealing layer, the design can, of course, also be such that a film layer is applied simultaneously on the upper and lower side of the sheet 1.

I claim:

1. A method for the mass preservation of archives, comprising the steps of:

forming an aqueous, pollutant-free, volatile solvent-free, thermoplastic binder dispersion with a high film-forming temperature above 60° C., said dispersion having a solids content, incorporating a wax-like substance selected from the group consisting of waxes or paraffins, into said dispersion by hot precipitation, said wax-like substance having a concentration of 3% to 10% by weight, based on the solids portion of the dispersion, to form a modified dispersion, impregnating a fabric on a supporting means with said modified dispersion, drying said modified dispersion on said fabric to form a substrate-sealing film, disposing said fabric on a substrate of said archives to be preserved, and applying pressure and a shock temperature appreciably exceeding a film-forming temperature to said fabric and said substrate of said archives to be preserved, so as to melt and fuse said substrate-sealing film to said substrate of said archives to be preserved under the action of pressure and temperature.

2. The method according to claim 1, wherein said fabric is selected from the group consisting of woven fabrics and non-woven fabrics.

3. The method according to claim 1, wherein said supporting means includes a supporting belt.

4. The method according to claim 1, wherein said supporting means includes a supporting roller.

5. The method according to claim 1, wherein said dispersion is selected from the group consisting of dispersions that are self-cross-linking, not self-cross-linkable and pre-cross-linked.

6. The method according to claim 1, further including the step of sealing the substrate on both sides with said substrate-sealing film reinforced by said fabric.

7. The method according to claim 1, wherein said fabric contains fibers selected from the group consisting of cellulose fibers, glass fibers, synthetic fibers and carbon fibers.

8. The method according to claim 1, wherein said dispersions are based on components selected from the group consisting of acrylates, methacrylates, and esters, nitriles and amides thereof; vinyl acetate; styrene; butadiene; vinyl propionate; isobutene; polyurethane; and vinylidine.

9. The method according to claim 1, further including the step of adding, to said dispersion, reactive diluents selected from the group consisting of polyols, polyethers, polyetherols and epoxides with, in each case, at least two reactive groups.

10. The method according to claim 1, wherein said wax-like substance is selected from the group consisting of lignite acid wax, lignite ester wax, polyethylene wax and natural wax, in conjunction with emulsifiers.

11. The method according to claim 10, wherein said emulsifiers are selected from the group consisting of ethoxylated oleic acid, ethoxylated fatty alcohol, oleic acid alkylolamide and ethoxylated castor oil.

12. The method according to claim 1, wherein said substrate-sealing film has a pH greater than 7.

13. The method according to claim 12, further including the step of adding solvent-free alkalis, which do not split off any pollutants, to the dispersion.

14. The method according to claim 13, further including the step of adding epoxidized oils to the dispersion.

15. The method according to claim 13, further including the step of adding 4-t-butyl pyrocatechol to the dispersion.

16. The method according to claim 1, further including the step of fusing said dried substrate-sealing film to said substrate with a surface in direct contact with said substrate-sealing film and at a temperature in the range of between about 100° and 200° C., such that said surface functions as an energy source.

17. The method according to claim 1, further including the step of immediately cooling the film after heating the same.

18. The method according to claim 1, further including the steps of:

applying the modified dispersion in liquid form on a transfer means, and melting said modified dispersion on said substrate on said transfer means.

19. The method according to claim 18, wherein said transfer means is a transfer roller.

20. The method according to claim 18, wherein said transfer means is an endless transfer belt.

21. The method according to claim 18, further including the step of supplying said fabric to said transfer means after said modified dispersion has been applied on said transfer means.

22. The method according to claim 18, further including the step of supplying said fabric to said transfer means before said modified dispersion has been applied on said transfer means.

* * * * *